United States Patent [19]

Exner

[11] Patent Number: 4,720,081

[45] Date of Patent: Jan. 19, 1988

[54] SCREW DRIVE SIX LINK SIDE LIFT VEHICLE JACK ASSEMBLY

[75] Inventor: Gregory F. Exner, Woodhaven, Mich.

[73] Assignee: General Motors Corporation, Detroit, Mich.

[21] Appl. No.: 43,971

[22] Filed: Apr. 29, 1987

[51] Int. Cl.[4] ..... B66F 3/00

[52] U.S. Cl. ..... 254/126

[58] Field of Search ..... 254/124, 126, 122, DIG. 1, 254/98, 100, 101

[56] References Cited

U.S. PATENT DOCUMENTS

| | | | |
|---|---|---|---|
| 2,361,690 | 10/1944 | Hunz . | |
| 2,435,693 | 2/1948 | De Orlow . | |
| 3,614,065 | 10/1971 | Adamski et al. . | |
| 4,093,182 | 6/1978 | Rutenbeck | 254/126 |
| 4,289,300 | 9/1981 | Weisser et al. | 254/126 |

FOREIGN PATENT DOCUMENTS

| | | | |
|---|---|---|---|
| 601453 | 3/1926 | France | 254/126 |
| 2030108 | 4/1980 | United Kingdom | 254/126 |

*Primary Examiner*—Robert C. Watson
*Attorney, Agent, or Firm*—William A. Schuetz

[57] ABSTRACT

A jack assembly which is adapted to engage a side frame of an automotive vehicle for the purpose of raising and lowering the same relative to its adjacent ground surface comprises a base for engaging the ground surface and which has a pair of upwardly extending sides having horizontally disposed slots therethrough, a main support link having one end pivotally connected to the sides of the base via a pivot means extending through the slots and having its other end pivotally connected to a screw nut means, a lift arm having one end pivotally connected to the main support link and its other end connected to a bearing means rotatably supporting a screw which is also threadably engaged with the screw nut means carried by the main support link, a positioning link having one end pivotally connected to the base and its other end pivotally connected to the lift arm and follower links having one end pivotally connected to the positioning link and its other end pivotally connected to the pivot means connecting the main support link to the base, and with the length of the positioning link and following links and the locations of their respective pivotal connections with the lift arm and positioning link being such that the bearing means of the lift arm follows an arc which is the natural arc of the frame or side body portion of the vehicle when used to raise and lower the same while simultaneously the follower link causes the first pivot means to slide in the slots and horizontally move the main support link so that its pivotal connection with the base is always located directly beneath the side frame of the vehicle being raised or lowered when the screw nut means is rotated.

5 Claims, 4 Drawing Figures

SCREW DRIVE SIX LINK SIDE LIFT VEHICLE JACK ASSEMBLY

The present invention relates to a vehicle jack assembly and, more particularly, to a vehicle jack assembly for engaging a side frame or underside body structure of an automotive vehicle for the purpose of raising and lowering the same relative to its adjacent ground surface.

Heretofore, various types of vehicle jack assemblies for raising and lowering a vehicle relative to its adjacent ground surface for various purposes, such as for changing a tire or tires have been provided. These have included up and down screw type jacks, ratchet pawl jacks and scissors-type jacks. These jacks also have been designed so that they raise and lower the vehicle in a straight vertical or substantially straight vertical path. Examples of such jack assemblies are shown in U.S. Pat. Nos. 2,361,690, 2,435,693 and 3,614,065. While these known jack assemblies have been successfully used, they nevertheless have some drawbacks, especially if used to lift a vehicle from its side. This is because the lifting parts of the jack assemblies are subjected to substantially high moments and bending stresses due to the fact that the vehicle being raised and lowered from its side rather than at its front or rear moves in a smaller radiused arc which in turn causes the weight of the vehicle being transmitted to the jack lifting head to be laterally offset from the transmission point of the weight to the jack base. This in turn requires that the various jack parts be made either of a heavier or a stronger material or both.

Accordingly, it is a broad object of the present invention to provide a new and improved jack assembly for raising and lowering an automotive vehicle, preferably from its side, and in which the jack assembly is so constructed and arranged that bending stresses or moment forces are eliminated or substantially minimized so that the jack assembly can be made of parts which are of a lower mass and cost.

Another object of the present invention is to provide a new and improved jack assembly for raising and lowering an automotive vehicle from its side and in which the jack assembly includes a lifting head which is engageable with a side frame or underside side body structure of the vehicle, a base for engaging an adjacently located ground surface and linkage means including a main support channel or link pivotally connected to the base, and in which the jack assembly is so constructed and arranged that the lifting head substantially follows the "natural" arc of the frame or side body structure of the vehicle as the vehicle is raised and lowered as well as simultaneously keeping the main support channel or link pivot with the base directly beneath the frame or side support structure of the vehicle as the latter is raised and lowered so as to prevent or minimize unwanted bending stresses normally generated by a lateral offset between the vehicle side frame or body structure and the pivot between the main support link and the base.

Yet another object of the present invention is to provide a new and improved jack assembly as defined in the preceding objects and wherein the base has a pair of upstanding sides provided with horizontal slots and the main support link is pivotally connected to the sides by pivot means horizontally slidable in the slots and wherein the jack assembly includes a lifting arm secured to the lifting head and which is pivotally connected to the main support link and positioning and follower links pivotally connected to each other and the main support link and lifting arm in a manner such that they function to prescribe an arc for the lifting head of the jack assembly which follows the natural arc of the vehicle side frame or body structure while simultaneously causing the pivot means between the main support link and the base to horizontally slide in the slots of the base to maintain the latter pivotal connection directly beneath the side frame or side body structure of the vehicle to minimize or prevent unwanted bending stresses normally generated by a lateral offset between the vehicle side frame or body structure and the pivotal connection between the main support channel and the base.

The above noted objects and provisions of the present invention are accomplished by providing a jack assembly which is adapted to engage the side frame or side body structure of an automotive vehicle for purposes of raising and lowering the same relative to an adjacent ground surface and which comprises, in general, a base for engaging the ground surface and which has a pair of spaced upwardly extending sides having horizontally extending slots therethrough, a main channel shaped link having its sides adjacent one end pivotally connected to the sides of the base by a first pivot means extending through the slots thereof for movement about a generally horizontal axis and having its sides adjacent its other end pivotally connected to a screw nut means for movement about a generally horizontal axis, a lift arm having one end pivotally connected to the sides of the main channel via a second pivot means for movement about a generally horizontal axis and its other end pivotally connected to a bearing means for movement about a generally horizontal axis and with the bearing means including a lifting head for engaging the side frame or body structure of the vehicle, a screw means having one end rotatably supported by the bearing means and which is threadably engaged with the screw nut means whereby the main channel support link and lift arm are caused to be raised and lowered when the screw means is manually rotated in opposite directions, positioning link means having one end pivotally connected to the base by a third pivot means for movement about a generally horizontal axis and its other end pivotally connected to the lift arm by a fourth pivot axis for movement about a generally horizontal axis, follower links having one end pivotally connected to the positioning link by a fifth pivot means for movement about a generally horizontal axis and its other end pivotally connected to the first pivot means, and wherein the length of the positioning and following links and the location of their respective pivotal connections with the lift arm and positioning link are such that the bearing means on the lift arm follows an arc which is the "natural" arc or substantially the "natural" arc of the side frame or side body structure of the vehicle when the jack assembly is used to raise and lower the vehicle while simultaneously the follower link means causes the first pivot means to slide in the slots and horizontally move the main channel support link so that its pivotal connection with the base is always located directly beneath the portion of the side frame or side body structure of the vehicle as it is being raised or lowered so that unwanted bending stresses or moments due to a lateral offset between the lifting head and the first pivot means are eliminated or substantially eliminated.

The present invention further resides in various novel constructions and arrangement of parts, and further objects, novel characteristics and advantages of the present invention will be apparent to those skilled in the art to which it relates and from the following detailed description of the illustrated, preferred embodiment hereof made with reference to the accompanying drawings forming a part of this specification and in which similar reference numerals are employed to designate corresponding parts throughout the several views, and in which.

Figure 1:
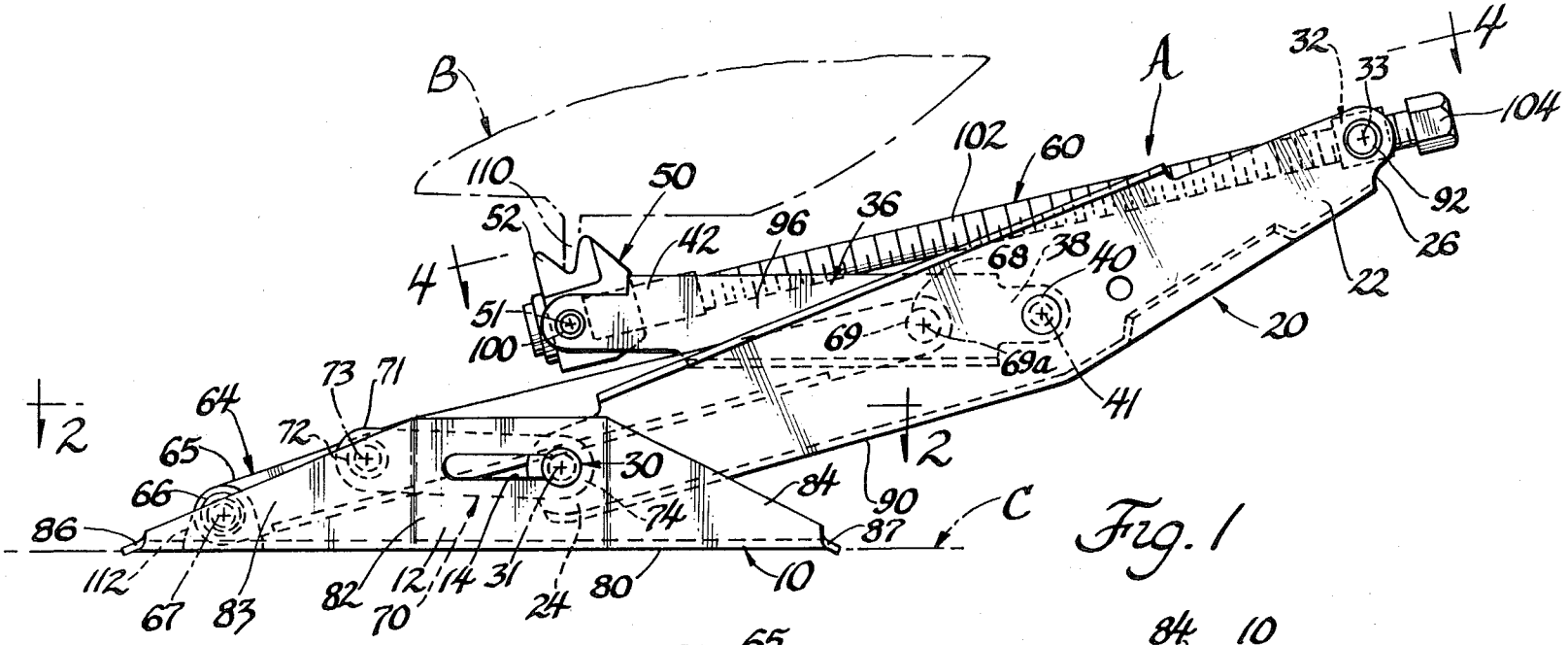
FIG. 1 is a side elevational view of the novel jack assembly of the present invention and showing the same in its lowered position.

The present invention provides a novel vehicle jack assembly A which is adapted to engage a side frame or a portion of the side body structure B of an automotive vehicle for the purpose of raising and lowering the same relative to its adjacent ground surface C. The jack assembly A can be used to raise and lower the vehicle for various purposes, but is most useful for raising and lowering the side body structure B thereof in order to be able to change one or more tires on the vehicle.

The novel jack assembly A, comprises in general, a base 10 for engaging the ground surface C and which has a pair of spaced upwardly extending sides 12 having horizontally extending slots 14 therethrough, a main channel shaped support link 20 having its sides 22 adjacent one end 24 pivotally connected to the sides 12 of the base 10 via a first pivot means 30 extending through the slots 14 for movement about a generally horizontal first axis 31 and having its sides 22 adjacent its other end 26 pivotally connected to a screw nut means 32 for movement about a generally horizontal second axis 33, a lift arm 36 having one end 38 pivotally connected to the sides 22 of the main support link 20 via a second pivot means 40 for movement about a generally horizontal axis 41 and its other end 42 pivotally connected to a bearing means 50 for movement about a generally horizontal axis 51 and with the bearing means including a head 52 for engaging the side frame or body structure B of the vehicle, a screw means 60 having one end rotatably supported by the bearing means 50 and which is threadably connected with the screw nut means 32 whereby the main channel shaped support link 20 and the lift arm 36 are caused to be raised and lowered when the screw means 60 is manually rotated in opposite directions, a positioning link 64 having one end 65 pivotally connected to the base 10 by a third pivot means 66 for movement about a generally horizontal axis 67 and its other end 68 pivotally connected to the lift arm 36 by a fourth pivot means 69 for movement about a generally horizontal axis 69*a*, a pair of follower links or link means 70 having one end 71 pivotally connected to the positioning link 64 by a fifth pivot means 72 for movement about a generally horizontal axis 73 and its other end 74 pivotally connected to the first pivot means 30.

Figure 3:
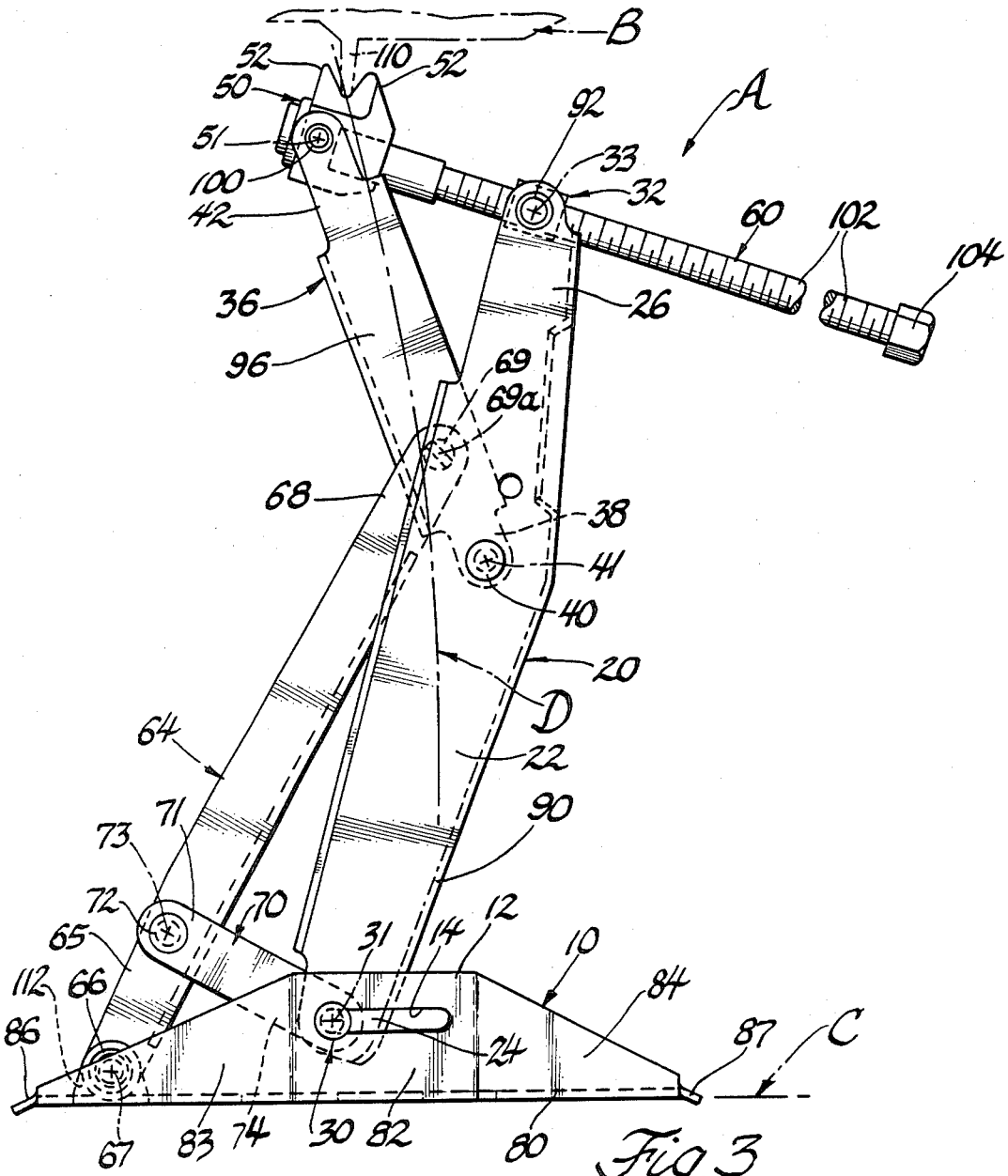
FIG. 3 is a side elevational view of the novel jack assembly of the present invention and showing the same in its raised position.
Figure 4:
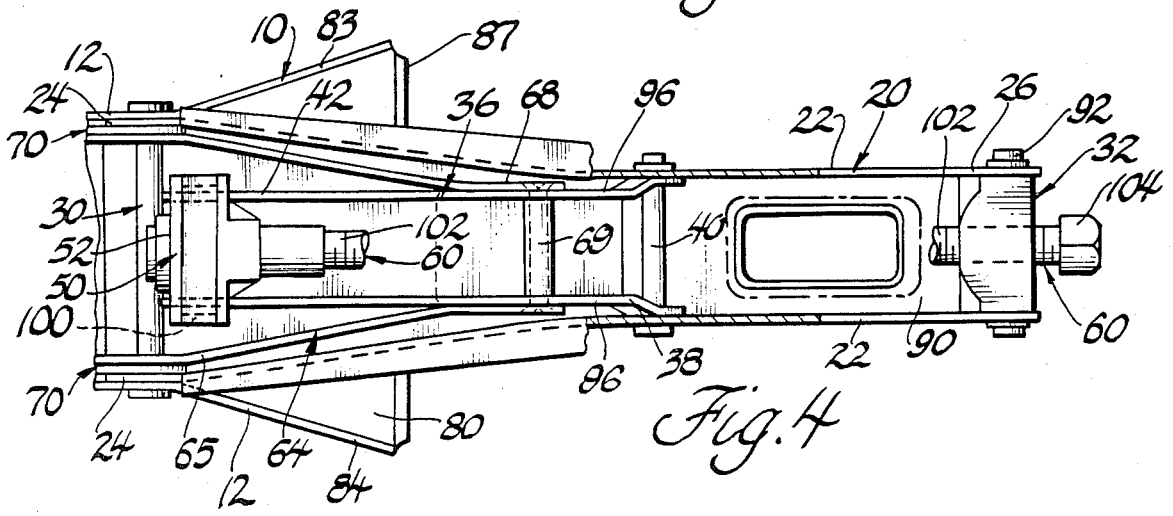
FIG. 4 is a top plan view of the novel jack assembly of the present invention and looking in the direction of the arrows 4—4 of FIG. 1.

The jack assembly A functions to cause the main channel support link 20 and the lift arm 36 thereof to be moved between their lowered or stowed position, as shown in FIG. 1, to a raised position, as shown in FIG. 3, in response to rotation of the screw means 60 in one direction and vice versa when the screw means 60 is rotated in the other direction. In addition, the length of the positioning link 64 and the following links 70 and the location of their respective pivotal connections with the base 10 and lift arm 36 and with the base 10 and the positioning link 64 being such that the bearing means 50 on the lift arm 36 follows an arc which is the "natural" arc or substantially the "natural arc" of the frame or side body portion B of the vehicle when the jack assembly A is used to raise and lower the vehicle while simultaneously the follower links 70 cause the first pivot means 30 to slide in the slots 14 in the base 10 to horizontally move the main channel support link 20 so that its pivot axis 31 or pivotal connection with the base 10 is always located directly beneath the portion of the side frame or body structure B of the vehicle being moved. This prevents or substantially prevents bending stresses or moments from being imparted to the jack assembly A due to any lateral offset between the point of contact between the head 52 and the frame B and the pivot axis 31 of the pivot means 30 at the base 10.

Figure 2:
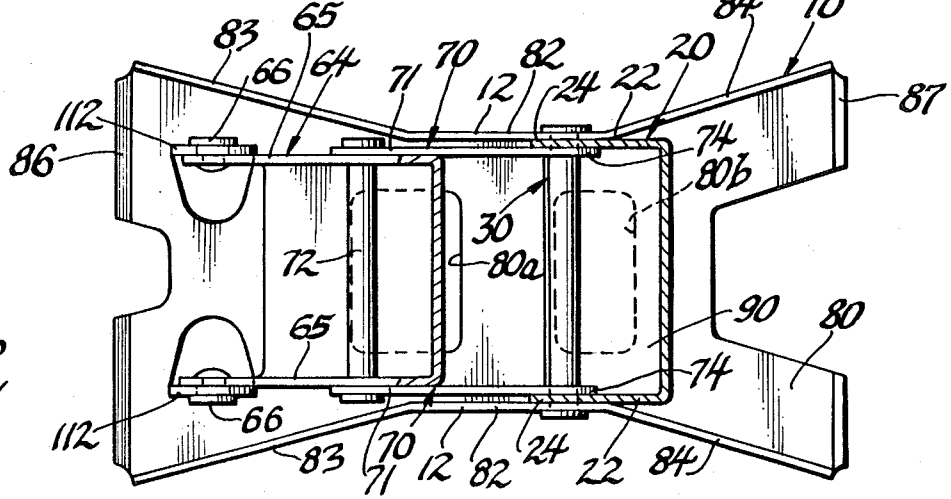
FIG. 2 is a fragmentary sectional view looking downward in the direction of the arrows 2—2 of FIG. 1.

The base 10 of the jack assembly A is generally U-shaped and stamped from sheet metal, preferably steel. Base 10 includes a bottom 80 and a pair of upstanding sides 12, each of which is provided with a horizontally extending slot 14 spaced upwardly from the bottom 80. The sides 12 each have a generally rectangularly shaped midportion 82 and tapered left and right end portions 83 and 84, as viewed in FIGS. 1 and 3, whose height progressively diminishes from the midportion 82 towards their free ends. As best shown in FIG. 2, the left and right portions 83 and 84 also diverge away from each other proceeding from the midportion 82 toward their free ends. The bottom 80 has cut out portions 80*a* and 80*b* adjacent its opposite ends and has its end surfaces 86 and 87 peened or bent downwardly so as to enable the base 10 to dig into a hard surface when placed thereon.

The base 10 pivotally supports the main support link or channel 20 of the jack assembly A. To the end, the main support link 20 is generally C-shaped and stamped from suitable sheet metal, such as steel. The main channel shaped link 20 has a bottom 90 and a pair of sides 22 and with the bottom 90 facing towards the plane of the bottom 80 of the base 10. The sides 22 of the channel link 20 adjacent their lower ends 24, as viewed in FIGS. 1 and 3, are pivotally supported via the pivot pin means 30 by the sides 12 of the base 10. The pivot pin means 30 can be of any suitable or conventional construction and is slidably received within the slots 14 of the sides 12 of the base 10. The main channel shaped support link 20 has its sides 22 at their upper ends 26, as viewed in FIGS. 1 and 3, suitably or conventionally pivotally connected to pivot pin means 92 secured to opposite sides of the screw nut means 32 at its opposite sides. The axes 31 and 33 of the pivot pin means 30 and pivot pins 92 are horizontal and the pivot pin means 92 can be of any suitable or conventional construction.

The main support link 20 also pivotally supports one end 38 of the lift arm 36 via the pivot pin means 40 for rotation about the horizontal axis 41. The lift arm 36 is generally U-shaped and stamped from suitable sheet metal, preferably steel, and has its opposite sides 96 at its lower end 38, as viewed in FIG. 3, pivotally connected to the main channel link 20 intermediate its ends by the pivot pin means 40. The lift arm 36 has its sides 96 at its upper end 42, as viewed in FIG. 3, pivotally supported via pivot pin means 100 secured to the opposite sides of the bearing means 50. The pivot pin means 40 and 100 can be of any suitable or conventional construction.

The bearing means 50 rotatably supports one end of the screw means 60 in any suitable or conventional fashion. The screw means 60 has a threaded portion 102 which is threadably engaged with screw threads (not shown) within the screw nut means 32 and has a tool engaging hexagonal end 104 so as to enable the same to be rotated in opposite directions. The bearing means 50 also includes a lift head or lift head portion 52 which can be of any suitable or conventional shape for engaging from its underside a frame or other side portion of an automotive vehicle. The lift head 52 is shown in FIGS. 1 and 3 as being V-shaped so as to straddlingly receive a downward tapered projection 110 on the underside of the frame B of the vehicle.

As can be seen from FIG. 3 of the drawings, rotation of the screw means 60 in a clockwise direction will cause the screw nut means 32 to move along the threaded portion 102 toward the bearing means 50. Likewise rotation of the screw means 60 in a counterclockwise direction will cause the screw nut means 32 to be moved away from the bearing means 50. This in turn will cause the upper ends 26 and 42 of the main support link 20 and the lift arm 36 to be moved about the pivot axis 41 toward and away from one another, respectively.

The base 10 of the jack assembly A also pivotally supports the positioning link or link means 64. The positioning link 64 is U-shaped and stamped from sheet metal, preferably steel, and has its opposite sides at one end 65 pivotally connected to a pair of ears 112 on the base 10 via pivot pin means 66 for movement about a horizontal axis 67. The ears 112 are upstruck from the bottom 80 of the base 10 adjacent its left end portion as shown in FIGS. 1, 2 and 3 and the ears 112 extend perpendicular to the bottom 80. The pivot pin means 66 can be of any suitable or conventional construction. The positioning link 64 has its sides at its upper end 68, as viewed in FIG. 3, suitably pivotally connected to the sides 96 of the lift arm 36 via suitable or conventional pivot pin means 68 and at a location intermediate the ends 38 and 42 of the lift arm 36. The sides of the positioning link 64 are also pivotally connected intermediate their ends 65 and 68 to one end of a pair of follower links 70 via suitable or conventional pivot pin means 72. The other end of the follower links 70 are pivotally connected to the sides 12 of the base 10 via the pivot pin means 30. The follower links 70 are also stamped from sheet metal, preferably steel.

Operation of the jack assembly A is as follows. When the jack assembly A is in its stowed or collapsed position, it is as shown in FIG. 1. In this position, the bearing means 50 and the screw nut means 32 are spaced furtherest apart from one another and the main channel shaped support link 20 and the link arm 36 are substantially horizontally disposed adjacent the bottom 80 of the base 10. Likewise the positioning link 64 and the follower links 70 are substantially horizontally disposed. This is the lowest height position of the jack assembly A.

When it is desired to raise the vehicle for some purpose, such as when it is desired to change a tire, the jack assembly A is positioned so that the base 10 is located directly beneath a projection 110 on the underside of the frame B of the vehicle and with the pivot pin means 30 being located directly beneath the projection 110. When the jack assembly A is in the stowed position shown in FIG. 1, the pivot pin means 30 is located at its rightmost location within the slot 14 of the base 10. When the screw means 60 is rotated in the clockwise direction by turning the hex nut 104 with a wrench, the screw nut means 32 will be caused to travel along the threaded portion 102 toward the bearing means 50. As this movement occurs, the upper ends 26 and 42 of the main support link 20 and the lift arm 36 respectively are caused to be moved towards each other. That is, the main support link 20 is caused to be rotated about the pivot pin means 30 in a counterclockwise direction and the lift arm 36 is caused to be rotated about its pivot pin means 40 in a clockwise direction. In addition, the positioning link 64 is caused to be rotated in a counterclockwise direction about its pivot axis 67 so that its pivotal connection 69 with the lift arm 36 is raised, which in turn causes the left end of the follower links 70, as viewed in FIGS. 1 and 3, to be raised and the follower links 70 rotated in a clockwise direction.

It should be noted at this point that since the vehicle is being raised from its side, that it will be raised about its two wheels on the opposite side of the vehicle so that the side of the vehicle being raised will travel in a somewhat arcuate path, designated by the reference numeral D. However, due to the provision of the positioning link 64 connected to the lift arm 36 and the follower links 70, the pivot pin means 30 for the main load supporting channel shaped link 20 will remain directly beneath the weight of the vehicle being transmitted to the jack assembly A via the projection 110 due to the fact that these links cause the pivot pin means 30 to slidably move within the slots 14 of the sides 12 of the base 10 from its rightmost position, as shown in FIG. 1, when the head 52 of the jack assembly A initially contacts the underside of the vehicle toward a more leftward position so as to maintain the axis 31 of the pivot 30 directly beneath the vertical line passing through the projection 110 of the vehicle. When the vehicle has been raised to its higher position where the tires on the side being raised are off the ground, it will more or less have the position shown in FIG. 3 in which the pivot pin means 30 is located at its leftmost position in the slots 14 of the sides 12 of the base 10.

An important advantage of having the weight of the vehicle being transmitted through the pivot means 30 at the base 10 of the jack assembly A always located directly beneath the lifting head 52 of the jack assembly is that it prevents or substantially prevents the jack assembly from being subjected to bending stresses and moments due to any lateral offset between the lifting head 52 and the pivot means 30. This increases the lifting capacity of the jack assembly or enables the components of the jack assembly to be made from lighter weight steel or material and still achieve the desired lifting capacity.

When it is desired to lower the vehicle, the screw means 60 is rotated in a counterclockwise direction by turning the hexagonal end 104 thereof. When this occurs, the reverse movements heretofore described in connection with raising the jack assembly occurs and ultimately the jack will be in the position shown in FIG. 1. Note that the positioning link 64 and the follower links 70 cause the pivot pin means 30 to be moved from its leftmost position, as shown in FIG. 3, towards its rightmost position, as shown in FIG. 1, so that while the vehicle is being lowered, the pivot means 30 is always directly beneath the weight of the vehicle so that no bending moments due to lateral offset between the lifting head 52 and the pivot pin means 30 occurs.

It should be noted that the length of the positioning link 64 and the following links 70 and the location of their respective pivotal connections with the lift arm 36 and positioning link 64 and the pivot means 30 can be determined such that the lifting head 52 of the bearing means 50 of the lift arm 36 will follow an arc which is the natural arc of the frame or side body portion of the vehicle to be raised and lowered while simultaneously the follower links 70 causes the first pivot means 30 to slide in the slots 14 of the base 10 and horizontally move the end 24 of the main support link 20 so that its pivotal connection 30 with the base 10 is always located directly beneath the projection 110 of the side frame or body structure B of the vehicle being moved when the screw means 60 is rotated to cause the lift arm 36 and main support link 20 to be raised and lowered.

From the foregoing it should be apparent that a novel jack assembly A has been provided which is of a relatively simple and inexpensive construction and which enables the vehicle to be raised and lowered through its natural arc while eliminating or substantially eliminating any bending stresses or moments due to the fact that the lifting head 52 engaging the vehicle is laterally offset with respect to the pivotal connection 30 between the main support link 20 and the base 10 of the jack assembly A.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A jack assembly which is adapted to engage an underside portion of side body structure of an sutomotive vehicle for the purpose of raising and lowering the same relative to its adjacent ground surface comprising:

a base for engaging the ground surface and which has a pair of spaced upwardly extending sides, each of said sides having a horizontally extending slot therethrough, a main support link means having one end pivotally connected to said sides of the base via a first pivot means extending through said slots for movement about a generally horizontal axis, said main support link means at its other end being pivotally connected to a screw nut means for movement about a generally horizontal axis, a lift arm having one end pivotally connected to said main support link means via a second pivot means for movement about a generally horizontal axis and its other end pivotally connected to a bearing means for movement about a generally horizontal axis, said bearing means including lifting head means for engaging an underside portion of the side body structure of the vehicle, a screw means having one end rotatably supported by said bearing means and which is threadably engaged with said screw nut means, said screw means causing said scew nut means to be moved toward and away from said bearing means and said lift arm and main support link means to be pivoted toward and from each other to raise and lower the same when rotated in opposite directions, a positioning link having one end pivotally connected to said base by a third pivot means for movement about a generally horizontal axis and its other end pivotally connected to said lift arm by a fourth pivot means for movement about a generally horizontal axis, follower link means having one end pivotally connected to said positioning link by a fifth pivot means for movement about a generally horizontal axis and its other end pivotally connected to said first pivot means, the length of the positioning link and following link means and the location of their respective pivotal connections with the lift arm and positioning link being such that the lifting head means of said bearing means on the lift arm follows an arc which is the natural arc of the side body portion of the vehicle when the screw means is rotated to raise and lower the vehicle while simultaneously the follower link means causes the first pivot means to slide in the slots in the base and horizontally move the main support link means so that its pivotal connection with said base is always located directly beneath the underside portion of the side body structure being moved when the screw means is rotated to raise and lower the lift arm and main support link means.

2. A jack assembly which is adapted to engage an underside portion of side body structure of an automotive vehicle for the purpose of raising and lowering the same relative to its adjacent ground surface comrising:

a base for engaging the ground surface and which has a pair of spaced upwardly extending sides, each of said sides having a horizontally extending slot therethrough, a main channel shaped support link having its sides adjacent one end pivotally connected to said sides of the base via a first pivot means extending through said slots for movement about a generally horizontal axis, said main support link having its sides adjacent its other end pivotally connected to a screw nut means for movement about a generally horizontal axis, a generally U-shaped lift arm having its sides at one end pivotally connected to said sides of said main support link via a second pivot means for movement about a generally horizontal axis and its sides adjacent its other end pivotally connected to opposite sides of a bearing means for movement about a generally horizontal axis, said bearing means including a lifting head for engaging an underside portion of the side body structure of the vehicle, a screw means having one end rotatably supported by said bearing means and which extends through and is threadably engaged with said screw nut means, said screw means causing respectively said screw nut means to be moved toward and away from said bearing means and said lift arm and main support link to be pivoted about said second pivot means toward and from each other to raise and lower said other end thereof when rotated in opposite directions, a generally U-shaped positioning link having its side adjacent one end pivotally connected to said base by third pivot means for movement about a generally horizontal axis and its sides adjacent its other end pivotally connected to the sides of said lift arm by a fourth pivot means for movement about a generally horizontal axis, follower link means having one end pivotally connected to said positioning link by a fifth pivot means for movement about a generally horizontal axis and its other end pivotally connected to said first pivot means, the length of the positioning link and following link means and the location of their respective pivotal connections with the lift arm and positioning link being such that the lifting head of said bearing means on the lift arm follows an arc which is the natural arc of the side body portion of the vehicle when the screw means is rotated to raise and lower the vehicle while simultaneously the follower link means causes the first pivot means to slide in the slots in the base and horizontally move the main support link so that its pivotal connection with said base is always located directly beneath the underside portion of the side body structure being moved when the screw means is rotated to raise and lower the lift arm and main support link.

3. A jack assembly, as defined in claim 2, and wherein said follower link means comprises a pair of follower links and wherein said base has a pair of spaced upstruck ears for pivotally supporting the sides of adjacent said one end of said positioning link.

4. A jack assembly, as defined in claim 2, and wherein said base adjacent its opposite ends is bent downwardly to provide edges which dig into the ground surface to retain the base in place when the jack assembly is used.

5. A jack assembly, as defined in claims 2 or 3, and wherein the main support links, lift arm positioning link follower link means and base are stamped sheet metal parts.

* * * * *